US007942653B2

(12) United States Patent
Stimpson et al.

(10) Patent No.: US 7,942,653 B2
(45) Date of Patent: May 17, 2011

(54) ELECTRIC SHOWER-WASTE PUMP AND CONTROL UNIT

(75) Inventors: Robert William Stimpson, Douglas (GB); Ian Felmeri, Castletown (GB); Yanchun Wang, Ballasalla (GB)

(73) Assignee: DLP Limited (IM)

( * ) Notice: Subject to any disclaimer, the term of this patent is extended or adjusted under 35 U.S.C. 154(b) by 646 days.

(21) Appl. No.: 12/019,670

(22) Filed: Jan. 25, 2008

(65) Prior Publication Data

US 2008/0199330 A1 Aug. 21, 2008

(30) Foreign Application Priority Data

Feb. 17, 2007 (GB) ..... 0703129.7
Apr. 30, 2007 (GB) ..... 0708265.4

(51) Int. Cl.
*F04B 35/04* (2006.01)

(52) U.S. Cl. ..... 417/423.11; 417/234; 417/423.14

(58) Field of Classification Search ..... 417/234, 417/423.3, 423.11, 423.14
See application file for complete search history.

(56) References Cited

U.S. PATENT DOCUMENTS

| | | | | |
|---|---|---|---|---|
| 4,218,195 | A * | 8/1980 | Shure | 417/411 |
| 4,810,897 | A * | 3/1989 | Shotey | 307/112 |
| 5,551,843 | A * | 9/1996 | Hauser | 417/234 |
| 5,772,408 | A * | 6/1998 | Hada et al. | 417/313 |
| 5,961,293 | A * | 10/1999 | Clemmons et al. | 417/44.2 |
| 2007/0048157 | A1 * | 3/2007 | Collins et al. | 417/423.3 |

FOREIGN PATENT DOCUMENTS

| | | |
|---|---|---|
| GB | 2310374 | 8/1997 |
| GB | 2355653 | 5/2001 |
| GB | 2426037 | 11/2005 |
| GB | 2424368 | 9/2006 |

OTHER PUBLICATIONS

British Search Report for GB 0708265.4, Aug. 30, 2007.

* cited by examiner

*Primary Examiner* — Devon C Kramer
*Assistant Examiner* — Peter J Bertheaud
(74) *Attorney, Agent, or Firm* — Martin Fleit; Paul D. Bianco; Fleit Gibbong Gutman Bongini & Bianco PL

(57) ABSTRACT

An electric shower-waste pump and control unit for pumping run-off shower water from a waste outlet to a drain, the unit comprising a housing having a first chamber and a separate second chamber which is water-tightly sealable, a removable housing cover for closing the housing, an electric pump provided in the first chamber, electronic control circuitry provided in the second chamber, and a removable second chamber cover for water-tightly sealing the second chamber against ingress of water leakage from the pump.

5 Claims, 5 Drawing Sheets

ELECTRIC SHOWER-WASTE PUMP AND CONTROL UNIT

BACKGROUND OF THE INVENTION

This invention relates to an electric shower-waste pump and control unit. Self-contained shower-waste pump and control units are known, and can be obtained from Autumn (UK) Limited of Ashton-under-Lyne, Lancashire, United Kingdom, Impey (UK) Limited of Ilton, Somerset, United Kingdom, and Digital Pumps Limited of Blackpool, Lancashire, United Kingdom.

Prior art examples of such units 1 are shown in FIGS. 1 to 3. Each unit 1 comprises a water-tightly sealable housing 2 in which is housed a shower-waste pump 3 and appropriate electronic control circuitry 4. An external mains AC electricity supply, typically of 230 or 240 volts, is connected via a connector 5 to a power transformer 6 forming part of the electronic control circuitry within the housing. The power transformer converts the mains voltage to a lower voltage suitable for operating the pump and the control circuitry.

Such a unit 1 is typically connected to a shower 7 as shown in FIG. 4. The shower head 8 is provided above a shower tray 9 having a waste outlet 10. The shower head is connected to a, typically wall-mounted, shower unit 11, which in turn is connected to a mains water supply 12.

A flow sensor 13 or sensors is/are connected to the shower-waste pump and control unit 1 and monitor operation of the shower unit. The shower-waste pump and control unit itself is connected to a mains power supply 14.

The waste outlet of the shower tray is connected to one port 15 of the pump 3 of the shower-waste pump and control unit, and another port 16 of the pump discharges to a drain pipe 17 and then to a soil pipe 18 of the building.

The problem with such prior art arrangements is that, should the pump leak, the water-tightly sealed box can fill with water. This leads to direct contact with the electrically energised control circuitry. The water leaking from the pump thus forms a conduction path back to the floor of the shower tray or base presenting a serious and potentially fatal risk of electrocution.

The pump utilised in such units is often of a diaphragm variety, and this kind of pump is well known to fail through diaphragm wear. Leakage of water through a worn diaphragm frequently occurs. The water can thus pass out of a pump housing and into the housing of the unit by flowing through an air vent hole intentionally provided for venting air from behind the diaphragm.

This is a known problem which has not heretobefore been addressed, and the present invention seeks to provide a solution.

SUMMARY OF THE INVENTION

According to the present invention, there is provided an electric shower-waste pump and control unit for pumping run-off shower water from a waste outlet to a drain, the unit comprising a housing having a first chamber and a separate second chamber which is water-tightly sealable, a removable housing cover for closing the housing, an electric pump provided in the first chamber, electronic control circuitry provided in the second chamber, and a removable second chamber cover for water-tightly sealing the second chamber against ingress of water leakage from the pump.

The present invention will now be more particularly described, by way of example only, with reference to the accompanying drawings.

DESCRIPTION OF THE PREFERRED EMBODIMENTS

Figure 1:
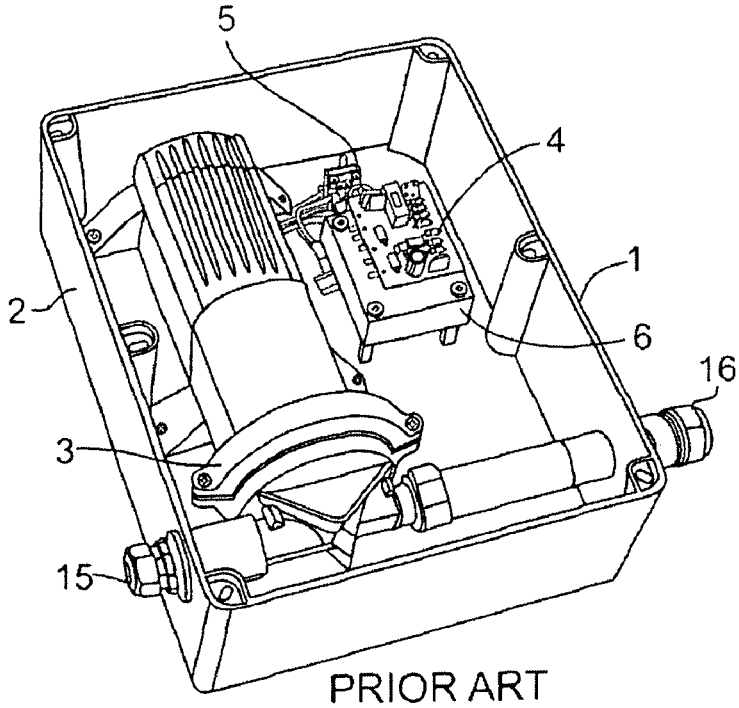
PRIOR ART FIG. 1
FIGS. 1 to 3 show first to third prior art electric shower-waste pump and control units.
Figure 2:
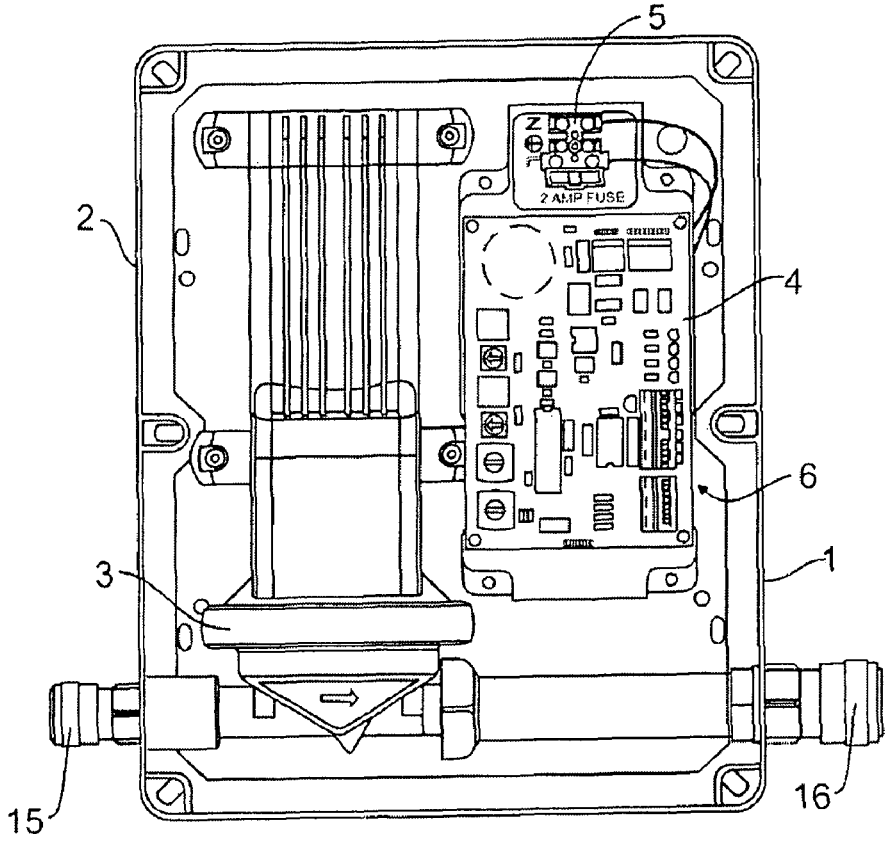
PRIOR ART FIG. 2
Figure 3:
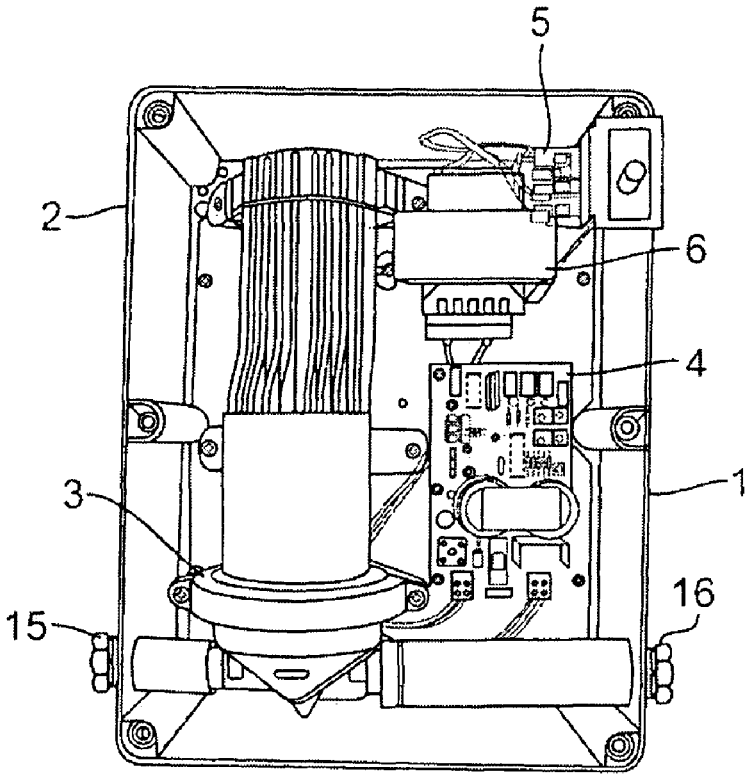
PRIOR ART FIG. 3
Figure 4:
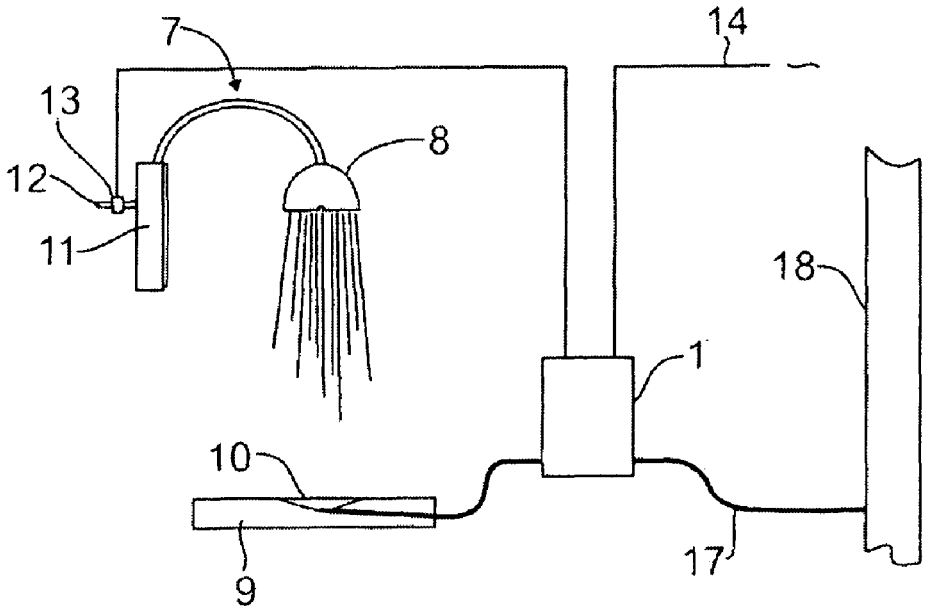
FIG. 4 shows a known standard installation of the electric shower-waste pump and control unit.
Figure 5:
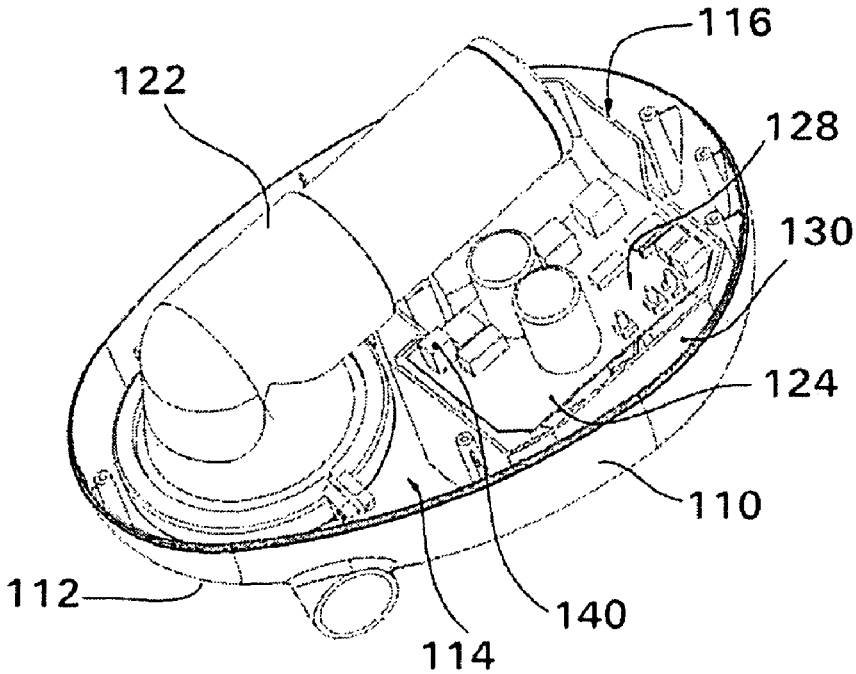
FIG. 5 shows a perspective view of a first embodiment of an electric shower-waste pump and control unit, in accordance with the invention and with a housing cover and a second chamber cover removed.
Figure 6:
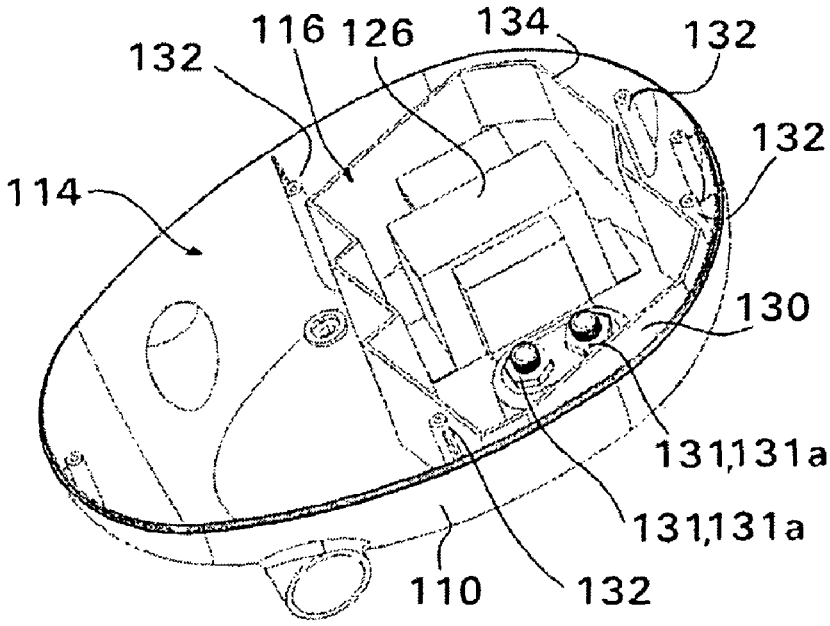
FIG. 6 is a view similar to FIG. 5, but with a shower-waste pump removed.
Figure 7:
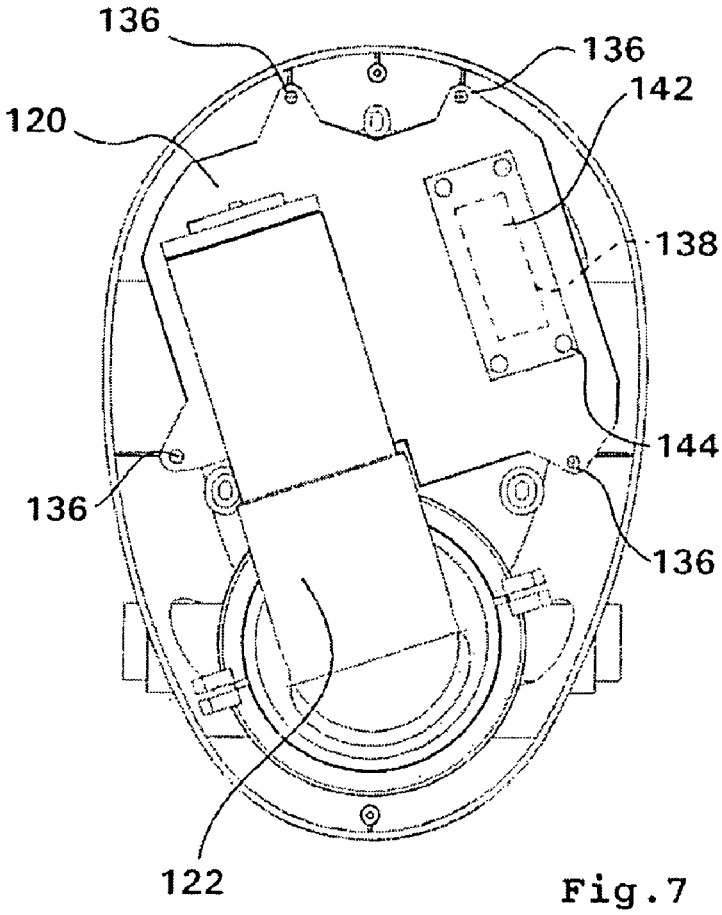
FIG. 7 is a plan view of the unit shown in FIG. 5, but with the second chamber cover in place.
Figure 8:
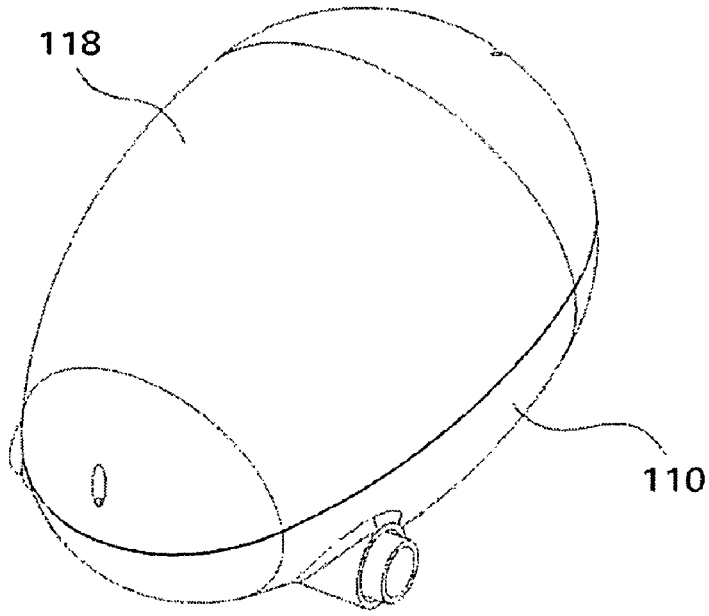
FIG. 8 is a perspective view of the unit shown in FIG. 5, but with the housing cover in place.

Referring to FIGS. 5 to 8, there is shown a first embodiment of an electric shower-waste pump and control unit 110 which comprises a, typically moulded plastics, housing 112 having a first pump chamber 114 and a second control-circuitry chamber 116, a removable housing cover 118 for closing the housing 112, and a removable second chamber cover 120 for closing the second chamber 116.

An electric shower-waste pump 122 is provided in the first chamber 114, and electronic control circuitry 124 is provided in the second chamber 116. The electronic control circuitry 124 includes a power transformer 126, and user-controls 128 for controlling and setting characteristics and/or parameters of the pump 122, such as ramp-up and ramp-down times, delay times, and pumping rate.

The second chamber 116 is separate of the first chamber 114, and is defined by a continuous wall 130 which is provided within the first chamber 114. The continuous wall 130 of the second chamber 116 is typically integrally moulded as part of the housing 112.

An opening (not shown) is typically provided in the wall of the second chamber 116, so that the pump 122 can be electrically connected to the control circuitry 124. A water-tight gland is provided in the opening.

The second chamber 116 also includes a second opening or openings 131 for the passage of a mains electricity supply cable (not shown). Again, the or each second opening 131 includes a water-tight gland 131*a*.

The second chamber cover 120 watertightly seals the second chamber 116 to IPx4 or IPx5 according to British Standard EN 60529. A sealing gasket (not shown) can be provided on a lower surface of the second chamber cover 120 to receive the continuous wall 130 of the second chamber 116.

Spaced-apart screw-port bosses 132 are integrally moulded within the first chamber 114 and are spaced from the continuous wall 130 of the second chamber 116. However, the continuous wall of the second chamber can include the spaced-apart screw-port bosses.

The second chamber cover 120 is thus releasably fastened to an upper edge 134 of the continuous wall 130, via screw-threaded fasteners 136 received in the screw-port bosses 132, in order to water-tightly seal the second chamber 116.

An access opening 138 is provided in the second chamber cover 120. The access opening 138 is positioned to allow simple unhindered access to the user-controls 128 and/or connectors 140 of the control circuitry 124 for use in commissioning purposes.

In this embodiment, a removable access cover 142 water-tightly closes the access opening 138, typically via a sealing gasket (not shown) and screw-threaded fasteners 144, to maintain the water-tight sealing of the second chamber 116.

Figure 9:
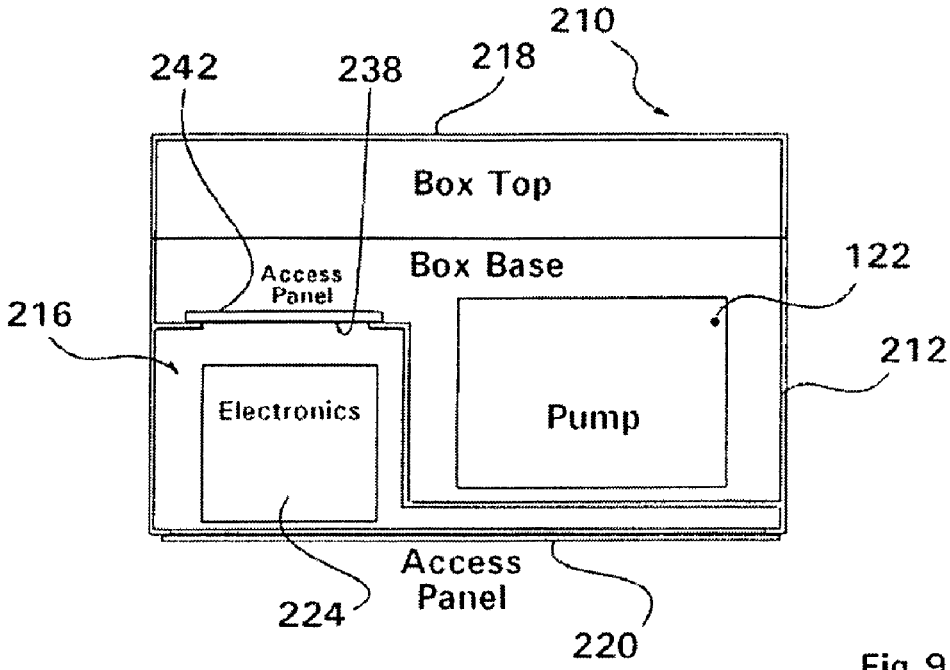
FIG. 9 is diagrammatic side view of a second embodiment of an electric shower-waste pump and control unit, in accordance with the invention.

Referring to FIG. 9, a second embodiment of an electric shower-waste pump and control unit 210 is shown. This embodiment is similar to that of the first embodiment, except a second chamber cover 220 is provided in or on a rear surface of housing 212.

Access cover 242 is spaced from the second chamber cover 220, and is accessible from the front of the housing 212 by removal of housing cover 218, as in the first embodiment.

As such, electronic control circuitry 224 is positioned within second chamber 216 from the rear of the housing 212 and prior to installation of the unit 210. Once installed, typically on a wall, access to the control circuitry 224 is only possible via access opening 238, and even then, only user-controls and/or connectors are typically accessible.

As in the first embodiment, the second chamber cover 220 and the access cover 242 water-tightly seal the second chamber 216.

Figure 10:
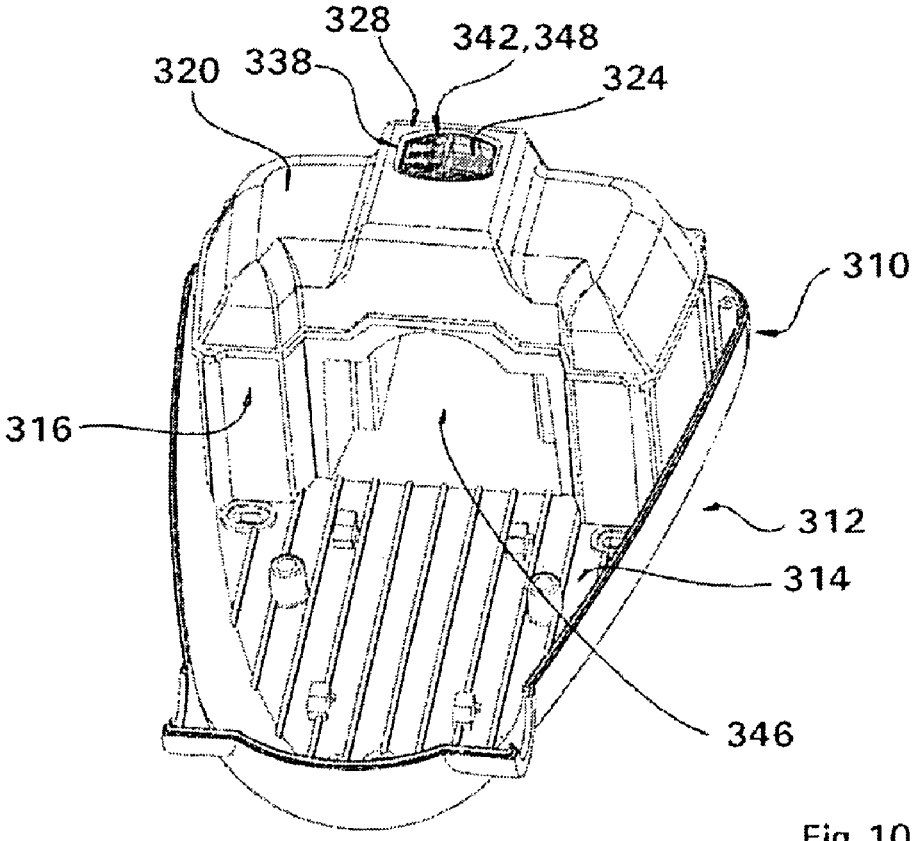
FIG. 10 is a perspective view of a third embodiment of an electric shower-waste pump and control unit, in accordance with the invention and with the front housing cover and pump removed for clarity.

Referring to FIG. 10, a third embodiment of an electric shower-waste pump and control unit 310 is shown. This embodiment is again similar to that of the first embodiment, and therefore like parts have like references, except with '300' added. FIG. 10 only shows a base of the housing 312 in which can be seen the first pump chamber 314, the second control-circuitry chamber 316, and the second chamber cover 320.

In this case, the second chamber 316 provides a bridge-shaped recess 346 for a pump motor (not shown), such that the second chamber 316 straddles the pump motor, when assembled.

The access cover 342 of this embodiment cannot be removed, and is instead a waterproof transparent or translucent flexible plastics membrane 348 which seals the access cover against the ingress of liquid. Since the membrane 348 is flexible, a user can manipulate the controls therebeneath through the membrane 348.

As such, with a housing cover removed, but with the second chamber cover 320 in place, the user controls 328 of the control circuitry 324 are only accessible via the access opening 338, although without requiring removal of the access cover 342.

Although the access cover of this embodiment is provided in the second chamber cover, similar to the first embodiment, it can be provided separately of the second chamber cover, similarly to the second embodiment.

The flexible access cover may be opaque with the controls embossed or printed thereon. Alternatively, the access cover can be a waterproof touch-sensitive control panel, such as a capacitative, inductive and/or piezoelectric device.

The housing cover of the embodiments described above not only closes the housing, but also closes the first chamber. The housing cover does not water-tightly seal the housing or the first chamber, thereby allowing drainage of water within the first chamber.

Screw-threaded fasteners are suggested, and these can be formed to be engagable by hand, instead of or in addition to the use of a tool, in order to simply removal and relocation of the second chamber cover and/or the access cover.

Alternatively, a releasable snap-lock fastening device or any other suitable device can be utilised in place of the aforementioned screw-threaded fastener.

Sealing of the second chamber cover and/or the access cover can alternatively be achieved by a moulded-in flexible gasket material applied to a bottom surface to form a compressible self-bonding sealing element.

Although the second chamber is formed integrally as part of the housing, the second chamber can be independent of the housing and simply attached therein when required.

It is thus possible to provide of a self-contained electric shower-waste pump and control unit which liquidly-isolates electronic control circuitry from its associated electric shower-waste pump and from water ingress via a misdirected shower head. It is also possible to provide such a unit which still allows simple user access to the control-circuitry.

The embodiments described above are given by way of examples only, and various other modifications will be apparent to persons skilled in the art without departing from the scope of the invention, as defined by the appended claims.

What is claimed is:

1. An electric shower-waste pump and control unit for pumping run-off shower water from a waste outlet to a drain, the unit comprising a housing having a first chamber and a separate second chamber which is water-tightly sealable, a removable housing cover for closing the housing, an electric pump provided in the first chamber, electronic control circuitry provided in the second chamber, a removable second chamber cover for water-tightly sealing the second chamber against ingress of water leakage from the pump, an access opening for operating the electronic control circuitry without removal of the second chamber cover, and an access cover for water-tightly closing the access opening, wherein the access opening is formed in the second chamber cover.

2. An electric shower-waste pump and control unit as claimed in claim 1, wherein the access cover is removable.

3. An electric shower-waste pump and control unit as claimed in claim 1, wherein the removable housing cover also closes the first chamber.

4. An electric shower-waste pump and control unit as claimed in claim 1, wherein the second chamber is integrally formed as part of the housing.

5. An electric shower-waste pump and control unit as claimed in claim 1, wherein the second chamber is independently formed separately of the housing.

* * * * *